United States Patent [19]

Pletz

[11] 4,214,685

[45] Jul. 29, 1980

[54] BACKPACK LOAD CARRYING SYSTEM FOR HIKERS

[75] Inventor: Murray J. Pletz, Mukilteo, Wash.

[73] Assignee: K-2 Corporation, Vashon, Wash.

[21] Appl. No.: 819,477

[22] Filed: Jul. 27, 1977

[51] Int. Cl.[2] ..... A45F 3/10

[52] U.S. Cl. ..... 224/211; 190/44; 224/213

[58] Field of Search ..... 224/5 Q, 5 W, 8 R, 9, 224/25 A, 101, 153, 209, 210, 211, 213; 190/44, 48; 403/220, 223, 229, 385

[56] References Cited

U.S. PATENT DOCUMENTS

| | | | |
|---|---|---|---|
| 518,270 | 4/1894 | Orth | 224/8 R |
| 1,296,619 | 3/1919 | Bulat . | |
| 1,448,918 | 3/1923 | Drager . | |
| 1,589,463 | 6/1926 | Drager . | |
| 1,637,635 | 8/1927 | Corley . | |
| 2,104,486 | 1/1938 | Johansen . | |
| 2,587,822 | 3/1952 | Corning | 403/220 |
| 3,000,656 | 9/1961 | Hollaender . | |
| 3,219,243 | 11/1965 | Mack . | |
| 3,347,429 | 10/1967 | Ruth, Jr. | |
| 3,437,059 | 4/1969 | Stonier et al. | 403/220 X |
| 3,536,237 | 10/1970 | Greenman . | |
| 3,563,431 | 2/1971 | Pletz . | |
| 3,733,017 | 5/1973 | Pletz . | |
| 3,734,366 | 5/1973 | Wood . | |
| 3,831,827 | 8/1974 | Olson | 224/25 A |
| 3,840,162 | 10/1974 | Horenstein et al. | |
| 3,851,980 | 12/1974 | Worth et al. | |
| 3,860,157 | 1/1975 | Richards et al. | |
| 3,912,138 | 10/1975 | Pava . | |
| 4,015,759 | 4/1977 | Dreissigacker et al. | 224/25 A |
| 4,018,370 | 4/1977 | Wood . | |

FOREIGN PATENT DOCUMENTS

| | | | |
|---|---|---|---|
| 826525 | 9/1937 | France | 403/385 |
| 1557297 | 3/1968 | France | 190/44 |
| 53574 | 2/1934 | Norway | 224/8 R |
| 383451 | 11/1932 | United Kingdom | 403/385 |
| 764880 | 1/1957 | United Kingdom | 224/8 R |

*Primary Examiner*—Charles E. Frankfort
*Assistant Examiner*—Winston H. Douglas
*Attorney, Agent, or Firm*—Graybeal & Uhlir

[57] ABSTRACT

A pack frame for hikers formed primarily of interconnected, hollow, tubular members and including in one embodiment a pivoting connector between a lower hip-engaging portion of the pack frame and an upper shoulder-engaging portion of the pack frame such that the upper and lower portions of the pack frame may pivot with respect to each other about the connector responsive to the motion of a hiker's hips and shoulders. A pack bag is disclosed having a pleated, connecting portion whereby the upper portion of the bag may pivot with respect to the lower portion. Also disclosed is a height-adjustable pack bag adapted to accommodate loads of varying size. A pack frame is also disclosed having segmented, vertically extending, laterally spaced, tubular side members, the segments of each side members being joined together by a flexible joiner member such that the upper portions of the tubular side members may resiliently tilt with respect to the lower portions. A flexible connecting joint for tubular members including an inner spring core substantially surrounded by a resilient covering which may be readily shaped to conform to the internal configuration of the tube members to be joined together.

32 Claims, 19 Drawing Figures

Fig. 1
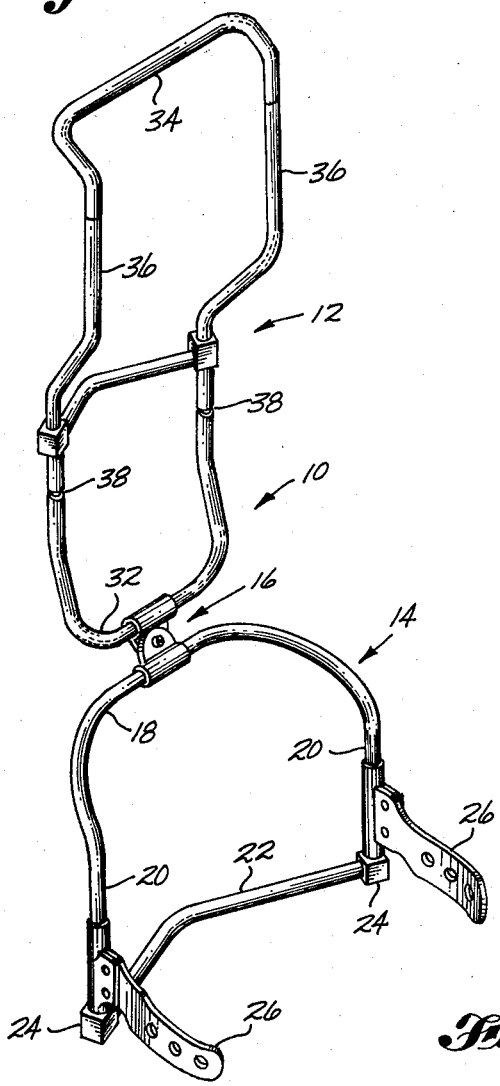
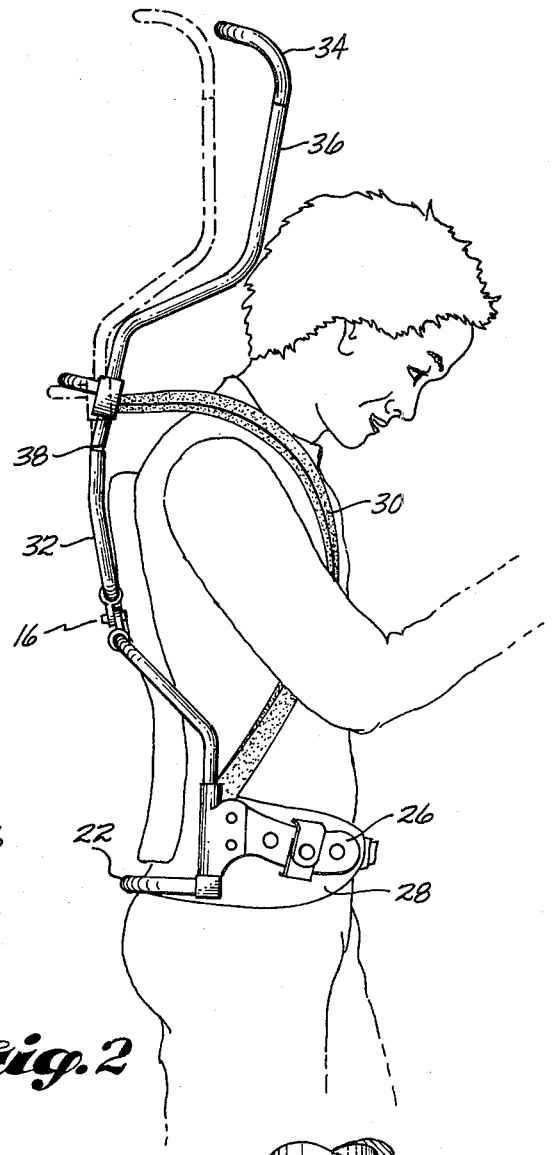
Fig. 2
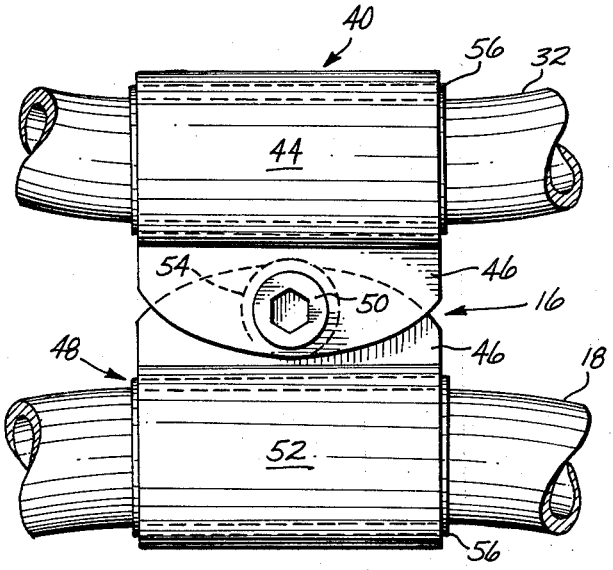
Fig. 3
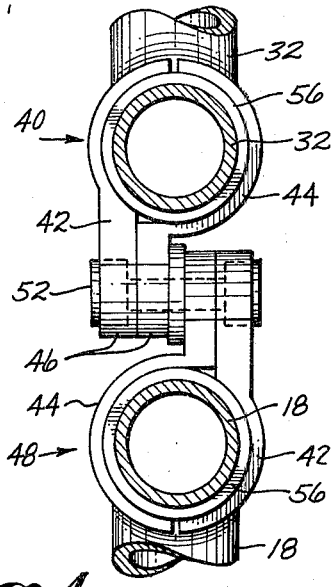
Fig. 4

Fig. 7
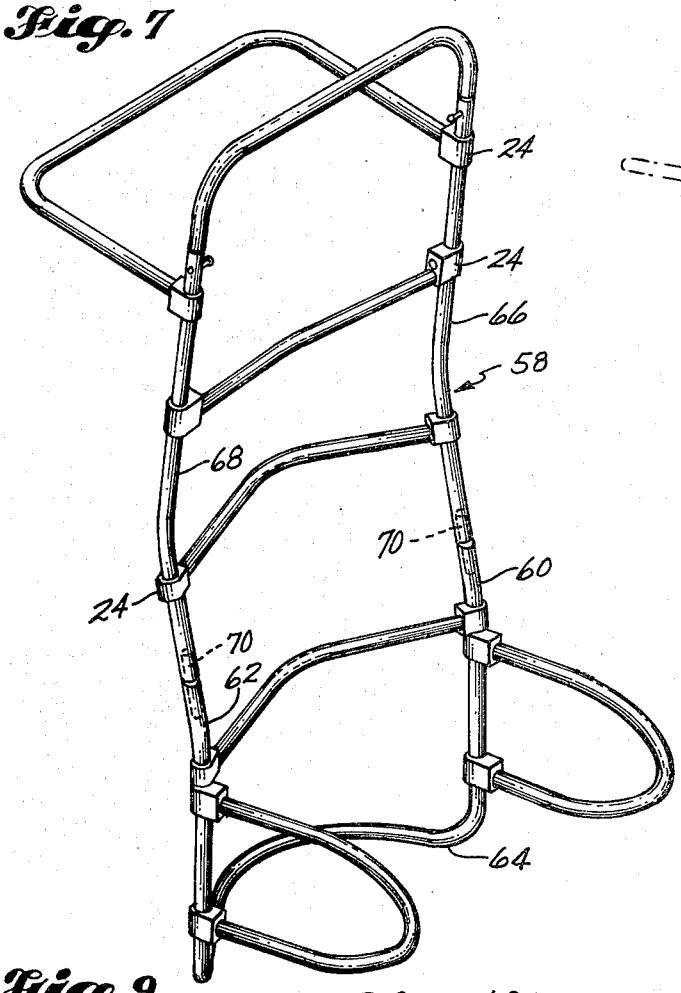
Fig. 8
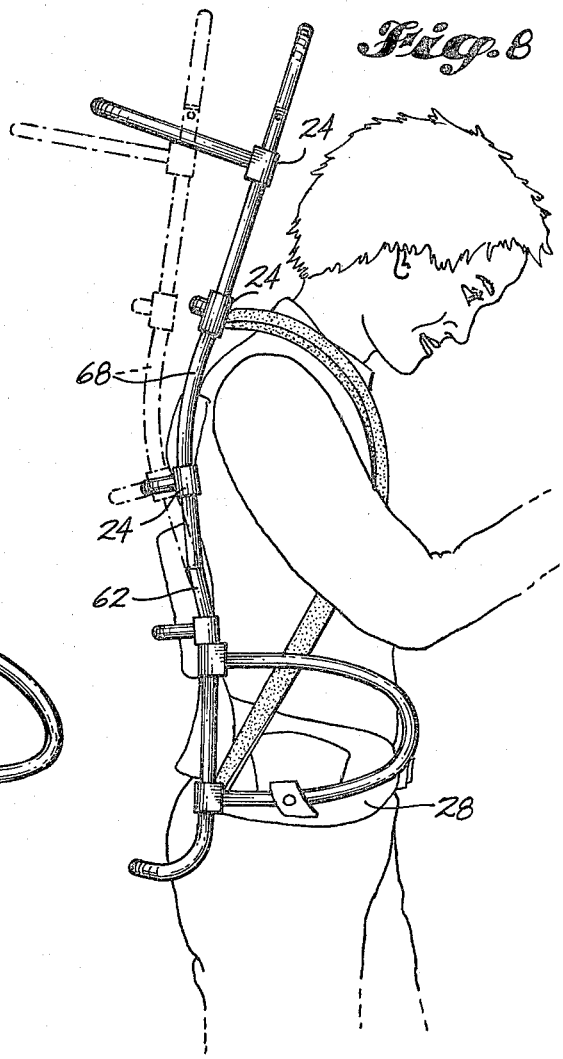
Fig. 9
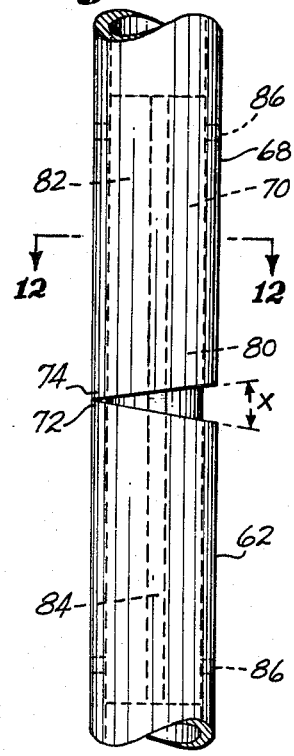
Fig. 10
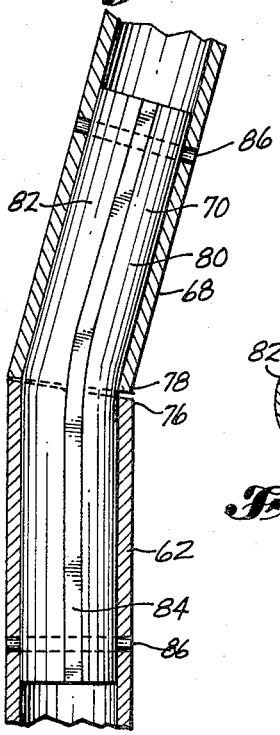
Fig. 11
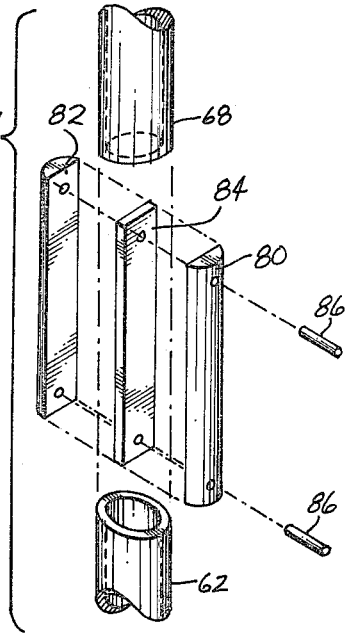
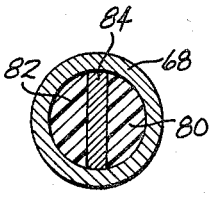
Fig. 12

Fig. 17
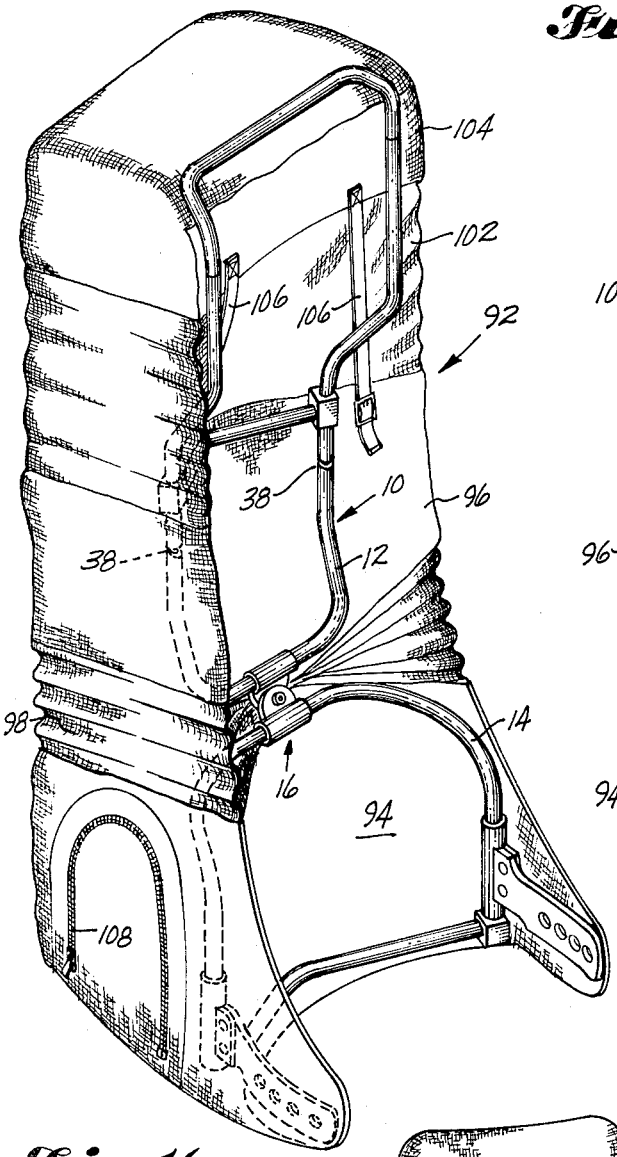
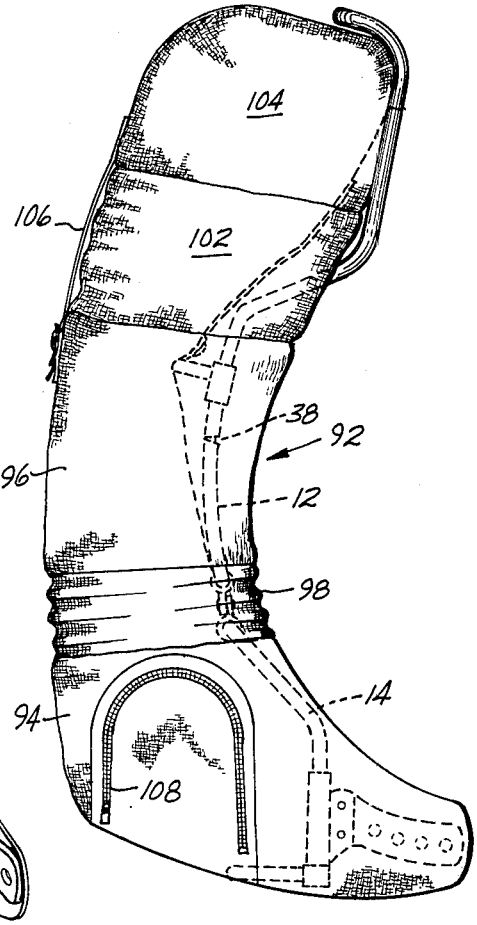
Fig. 16
Fig. 19
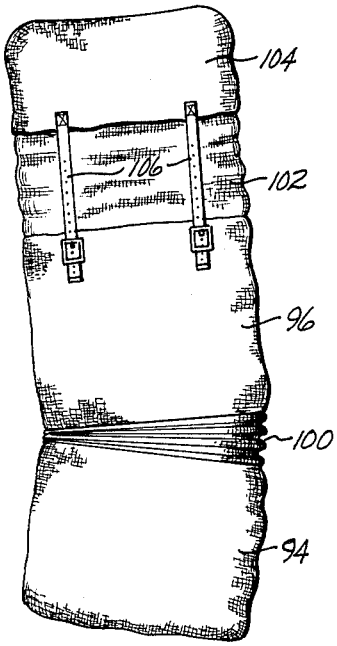
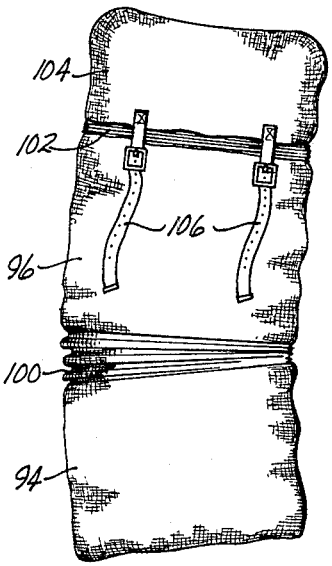
Fig. 18

BACKPACK LOAD CARRYING SYSTEM FOR HIKERS

BACKGROUND OF THE INVENTION

1. Field of the Invention

This invention relates, in general, to load carrying systems for hikers, and in particular, to an improved flexible pack frame having a lateral, pivoting joint and/or resilient flex joints connecting adjacent parts of the pack frame and allowing the pack frame to support the load to be carried in close proximity to the wearer's body while closely following the movement of the wearer's hips and shoulders. A pack bag having a pleated portion which allows the upper and lower portions of the bag to follow the respective movements of the hips and shoulders of a hiker in an improved manner is also disclosed.

2. Description of the Prior Art

Stuides of human anatomy have been shown that the when a person is walking, the hips, supported by the legs, pivot about the lower portion of the spine, and that the spinal column itself resembles a flexible cable which joins the lower torso to the upper torso. The arms and shoulders, in turn, pivot about the upper end of the spinal column. While the lower torso is best suited for supporting a load that is carried on the body, this burden is most efficiently carried when it is as close as possible to the upper body and distributed about the upper body in such a way that its weight can be transferred, to a substantial degree, to the waist and lower torso area.

Flexible pack frames are known, such as shown in my prior U.S. Pat. Nos. 3,563,431 and 3,733,017, as well as in U.S. Pat. No. 3,734,366.

Also known are hip belt and shoulder strap systems for backpacks, such as shown in U.S. Pat. Nos. 2,104,486, 3,347,429, 3,536,237, 3,831,827 and 3,840,162, which have attempted to provide for the transfer of a pack load from the shoulders to the hips of the wearer and to control the movement of the pack frame in response to the movement of the hips and shoulders of a hiker.

None of the above prior patents, although occasionally disclosing significant advances in the art, have disclosed pack frames able to follow both the vertical and rotational movements of the hips and shoulders of the human body while walking to the degree possible with the pack frame of the present invention. Neither have these patents disclosed pack frames which allow the load carried on the frame to be closely distributed about the upper body of the wearer both when the hiker is walking on level ground and when the hiker is either climbing or descending a steep grade.

The prior art additionally includes early patents disclosing apparatus for assisting in carrying equipment on the human torso, which apparatus includes hinges or pivot points such as U.S. Pat. Nos. 1,296,619, 1,448,918, 1,589,463 and 1,637,635. The apparatus disclosed in these patents not only functions differently from the pack frame system of the present invention, but also is not directed to the solution of the problem solved by the present invention, namely, the provision of a flexible pack for hikers which allows a load to be carried such that the pack moves with the body of the hiker in a manner responsive to the relative vertical, lateral and rotational movements of the hips and shoulders of the hiker such that the load is maintained in close proximity to the torso of the hiker at all times.

Pack frames formed of interconnected tubular members are also known, such as shown in U.S. Pat. Nos. 3,860,157, 3,912,138, 3,219,243 and 4,018,370. These patents disclose structures for joining tubular members having a different function and design than the joiner member of the present invention. U.S. Pat. Nos. 3,000,656 and 3,851,980 also disclose tubular joiner members, in general, which also differ in structure and design from the joiner members of the present invention. Copies of all of the above-listed patents were submitted to the Patent Office at the time of the filing of this application.

BRIEF SUMMARY OF THE INVENTION

This invention relates to pack frames of the type usually formed of lightweight, hollow tubing. In one embodiment, the pack frame includes an upper shoulder portion and a lower hip portion interconnected by a pivot joint which allows the upper and lower portions of the pack frame to pivot with respect to each other in response to the lateral and vertical movement of the wearer's hips and shoulders.

In another embodiment, flexible, resilient joints are provided in the vertical side members of the pack frame at a point between the wearer's hips and shoulders. These joints allow the upper portions of the side members of the pack frame to flex forwardly with respect to the lower portions of the side members, in response to forward or rotational movement of the wearer's shoulders. In one embodiment, the connecting joints include a flat spring sandwiched between resilient spacer members. The spacer members are preferably formed of a material which tends to return, at least in part, to its original shape after deformation and which may be easily shaped to allow the connector to be disposed endwise into the adjacent ends of the hollow tubular members to be joined. Alternatively, the flexible connecting joints may be pinned in place between the ends of the tubes.

In another embodiment a pack bag is provided which is constructed such that the upper portion of the bag may be easily tilted with respect to the lower portion of the bag thus allowing the pack bag, even when loaded, to move with the flexible pack frame disclosed. A pack bag having a foldable upper portion is also provided to allow the carrying capacity of the bag to be varied.

The instant invention thus discloses a pack frame system which is both lightweight and flexible, and which may include a pivoting connection joint between the shoulder and hip portions of the frame, and a pack bag adapted to follow such pivoting movement. The invention may include novel flexible connecting joints between adjacent tubular members to allow the upper portion of the pack frame to tilt forwardly allowing the load to be maintained in close proximity to the body of the wearer, as well as allowing the load to twist with the twisting movement of the wearer's body while walking. Multiple flex joints spaced vertically along each of the upwardly extending side members of the frame may also be employed.

BRIEF DESCRIPTION OF THE DRAWINGS

FIG. 1 is a perspective view of one embodiment of a typical pack frame constructed according to the present invention.

FIG. 2 is a side elevation view of the pack frame of FIG. 1 mounted on a hiker, and including shoulder straps and a hip belt, and additionally showing the top portion of the pack frame tilted forwardly with respect to the bottom portion of the pack frame, the non-tilted location of the frame being shown in broken line.

FIG. 3 is a front elevational view of one typical embodiment of a pivoting connecting joint made according to the instant invention.

FIG. 4 is a side elevational view of the pivoting connecting joint of FIG. 3.

FIG. 7 is a perspective view of another embodiment of a typical pack frame made according to the instant invention including flexible joiner members between the upper and lower portions of the pack shown in dotted line.

FIG. 8 is a side elevational view of the pack frame of FIG. 7 mounted on a hiker, and including shoulder straps and a hip belt, and additionally showing the top portion of the pack frame tilted forwardly with respect to the bottom portion of the pack frame, the non-tilted location of the frame being shown in dotted line.

FIG. 9 is an elevation view of one embodiment of a typical flexible joiner member between two tubular members made in accordance with the instant invention, including tubular members having beveled end portions forming an angle designated as "x".

FIG. 10 is a section view of the flexible joiner member of FIG. 9 shown with the upper tubular member tilted with respect to the lower tubular member.

FIG. 11 is an exploded elevation view of one typical embodiment of a flexible joiner member made in accordance with the instant invention disposed between the ends of two tubular members to be joined.

FIG. 12 is a section view along line 12—12 of FIG. 9.

FIG. 16 is a perspective view of a typical load carrying system made in accord with the present invention showing the hidden portion of the pack frame in broken line, and showing a pack bag including a pair of bellows-like connectors.

FIG. 17 is a side elevation view of the load carrying system of FIG. 16.

FIG. 18 is an elevation view of one typical embodiment of a pack bag made in accord with the present invention including a pleated connecting portion between the upper and lower portions of the bag.

FIG. 19 is an elevation view of the pack bag of FIG. 18, tilted in the opposite direction, and showing the top end portion of the bag in a collapsed position to accommodate a smaller load.

DETAILED DESCRIPTION OF THE INVENTION

Figure 5:
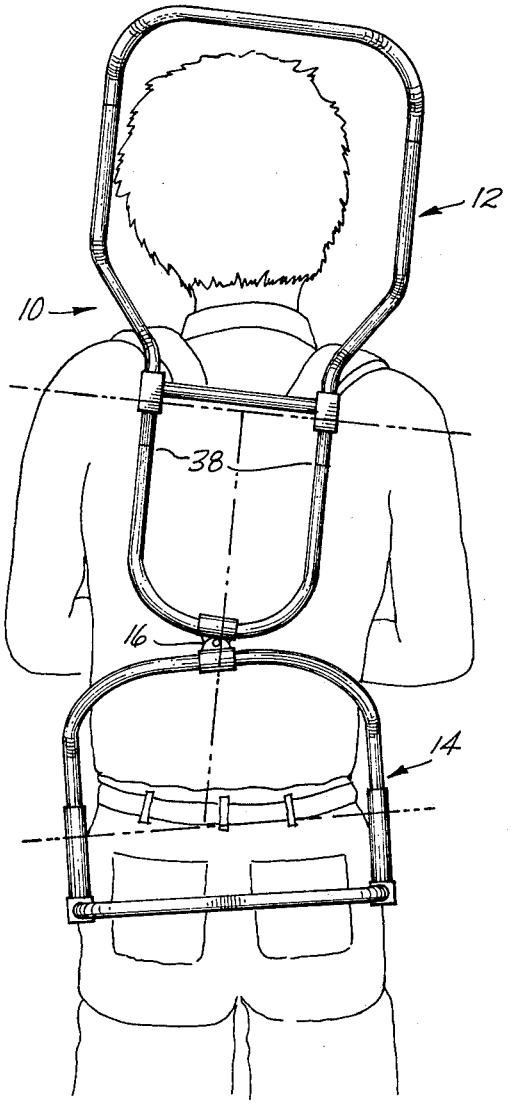
FIG. 5 is a rear elevational view of one embodiment of a typical pack frame constructed according to the present invention shown mounted on the back of a person stepping forward with his right foot.

Referring to FIG. 1, one typical embodiment of the present invention comprising a back pack frame 10 is disclosed. Pack frame 10 comprises a closed tubular upper section 12 and a closed tubular lower section 14 interconnected by a pivoting connector 16. The manner of construction and operation of pivoting connector 16 will be described in detail hereafter with respect to FIG. 3 and 4.

The lower section 14 of the frame includes an upper tubular portion 18, tubular side portions 20, and a tubular lower portion 22 interconnected to side portions 20 by means of conventional connectors 24. As illustrated, side portions 20 and upper portion 18 are formed of a single curved tubular member, but it will be understood that, if desired, lower section 14 may be formed of a greater or lesser number of tubular elements interconnected by connectors such as 24.

Hip arms 26 are shown connected to the lower section of the pack frame, and as is best seen in FIG. 2, these hip arms are adapted to be detachably connected to hip belt 28 through which the pack frame is connected to the hips of the wearer. It will be understood that the frame is also held on the back of the wearer by means of shoulder straps 30, the ends of which are connected to the upper and lower sections of the pack frame in a conventional manner.

The upper section 12 of pack frame 10 includes a lower, substantially U-shaped, member 32 which is interconnected with pivotal connector 16. Section 12 also includes an upper U-shaped member 34 and a pair of generally upwardly extending side members 36, extending between and interconnecting the upper and lower members 32 and 34. As will be discussed in greater detail hereafter with respect to FIGS. 7–15, flexible joiner members may be provided at connecting points 38, or at connecting points along the sides of the upper section of the pack frame between the hips and shoulders of the wearer, to allow elements 36 to flex forwardly with respect to the lower tubular elements 32 such that the weight carried on the pack frame may be maintained closely adjacent the body of the wearer. This tilting of the top portion of the pack frame has particular advantages to the wearer when the wearer is ascending or descending a hill and is thus bending at the waist.

Referring to FIG. 2, the upper members 34 and 36 of the pack frame are shown in broken line in their normal, non-tilted position, while in full line, these members are shown tilted forwardly with respect to lower member 32. As will be understood, the forward tilting of the top portion of the pack frame to generally conform to the forward movement of the wearer's body, allows a load carried in a pack bag attached to the pack frame to be maintained substantially aligned with the center of gravity of the wearer, rather than being rearwardly displaced therefrom where it would tend to create moment forces which would be likely to pull the hiker off balance with the slightest misstep, or at the least, create a tiring strain upon the wearer as compared to a pack load carried very closely to the wearer's body as is possible with the pack frame of the present invention.

Referring now to FIGS. 3 and 4, one typical embodiment of a pivoting connector 16 is disclosed to comprise a pair of identical upper and lower connecting portions adapted to encircle and grip members 32 and 18 of the upper and lower sections of the pack frame respectively. Upper connecting portion 40 includes an outer fitting 42 and an inner fitting 44, each adapted to partially encircle tube 32, and each including downwardly extending shank portions 46. In like manner, the lower connecting portion 48 includes an inner fitting 44 and an outer fitting 42 with each of said fittings also including upwardly extending shank portions 46.

Shank portions 46 of the fittings all include openings therein which are aligned to receive a conventional fastener such as a threaded bolt 50 and a cooperating internally threaded nut 52. A washer 54, formed of any suitable material such as nylon or the like, is shown positioned between the shank members of the upper and lower connecting portions. Washer 54 acts both to lubricate the relative pivoting movement of the upper and lower sections of the pack frame to reduce wear, and to allow the relative freedom of movement of the upper and lower portions of the pack frame to be controlled responsive to the tightening of bolt and nut combination 50 and 52 and the resultant squeezing of washer 54. The engagement between bolt 50 and nut 52 can be adjusted to thus apply a torque pre-load to pivoting connector 16, which pre-load must be overcome for upper section 12 to pivot laterally relative to lower section 14. The construction of connector 16 enables upper section 14 to pivot relative to lower section 12 responsive to the movements of the shoulders and hips, respectively, without generating a reactive countermovement tending to return frame 10 to a "neutral" position. This characteristic inherent in the structure of pivoting connector 16 is important since the human body in its normal movements also does not generate reactive countermovements.

To reduce wear and prevent deformation of the tubular portions of the pack frame themselves, protective sleeves 56 may be provided between the tubular members and the upper and lower connecting portions. The sleeves 56 are preferably formed of a durable plastic material such as polyethylene, although it will be understood that any other suitable material could be substituted therefor, or the protective sleeve could be eliminated completely, although it is believed this could be detrimental to the useful life of the pack frame.

While one particular form of pivoting connector has been disclosed above, it will be understood that any other means whereby unitary upper and lower portions of a pack frame may be joined at a central point between the shoulders and hips of a wearer could be substituted therefor. For example, it is contemplated that shank elements could be welded directly to the adjacent tubular members of the upper and lower portions of the pack frame, rather than clamping these tubular members as pictured in the accompanying drawings. Alternatively, the adjacent members of the upper and lower sections of the pack frame could be pivotally pinned directly together. To facilitate such pinning, flat rather than tubular members could be employed in said adjacent sections. In still another embodiment, the upper and lower portions of the pack frame could be joined by a durable, flexible fabric or plastic material which, when positioned at substantially the location of pivoting connector 16, would also allow the upper and lower portions of the pack frame to pivot laterally with respect to each other in the manner illustrated in FIGS. 5 and 6.

Figure 6:
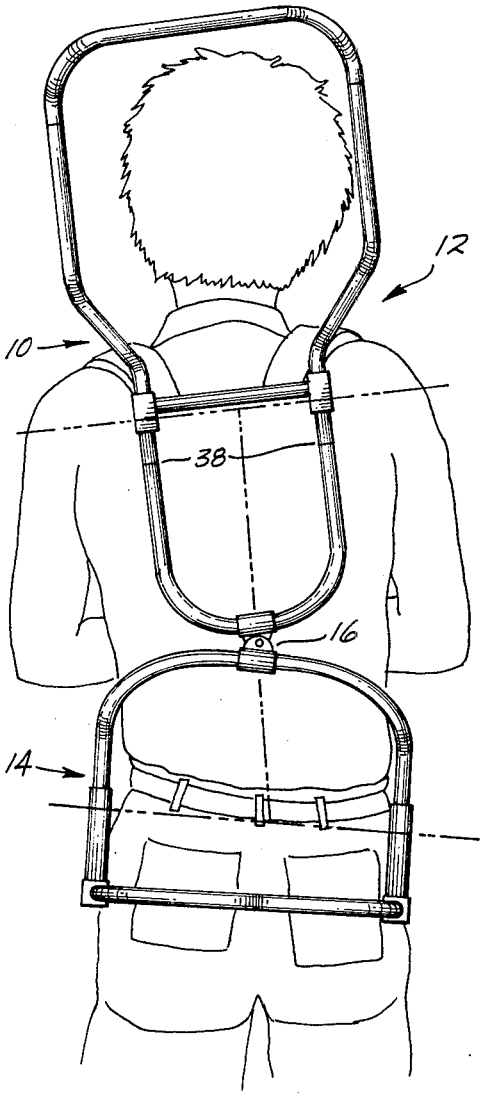
FIG. 6 is a rear elevational view of one embodiment of a typical pack frame constructed according to the present invention shown mounted on the back of a person stepping forward with his left foot.

FIGS. 5 and 6 illustrate the unique pivotal movement of applicant's pack frame responsive to the relative movement of the hips and shoulders of a wearer while walking. In FIG. 5, the wearer is shown stepping forward with his right foot, thus causing the wearer's right hip to rise while the wearer's right shoulder drops. The upper and lower portions of the pack frame pivot responsive to this hip and shoulder movement, thus allowing the pack frame, and the load carried thereon, to move with the body of the wearer rather than against the wearer's body as is common with all prior, relatively rigid, packs. In like manner, in FIG. 6, the wearer is shown stepping forward with his left foot, consequently causing his left hip to rise and his left shoulder to drop, and elements 12 and 14 of the pack frame are shown pivoting in the manner discussed above to accommodate this movement of the wearer's body.

Referring now to FIG. 7, another typical embodiment of a pack frame embodying the invention of this application is disclosed. Pack frame 58 is shown to include a unique means of connection of the laterally spaced upper ends 60 and 62 of the generally U-shaped bottom section of the frame 64 with the lower ends of tubular side frame members 66 and 68. As shown, flexible joiner members 70 are shown positioned to extend between and join the adjacent ends of the elements 60 and 66, and 62 and 68 respectively.

In FIG. 8, it will be seen that the interconnection of elements 62 and 68 by means of the flexible joiner member 70 allows the upper portion of the pack frame to flex forwardly, responsive to forces exerted thereon, either by shoulder straps 30, or by the load being carried on the pack frame when the hiker bends forward at the waist, such as when climbing or descending a steep trail. The flexing of the load forwardly allows the center of gravity of the load carried on the pack frame to be maintained closely in line with the center of gravity of the wearer's body, thus making the load easier to carry.

Additionally, it will be understood that the use of flexible joiner members 70 to interconnect the side elements of the pack frame allows side members such as 66 and 68 to flex forwardly independently of each other, responsive to normal twisting forces exerted on the pack frame during walking. As discussed heretofore with respect to FIGS. 5 and 6, when a person steps forward with his right foot, his right shoulder tends to drop while his right hip rises. Such description, of course, only deals with movement of the body in the vertical plane, and it will be understood that, in addition, the spine of the walker twists causing the right shoulder of the walker to move forwardly as well as downwardly, while the walker's left shoulder twists rearwardly. The use of flex joints 70 to connect members such as 62 and 68 allows the upper portion of the pack frame adjacent the wearer's right shoulder to also twist and flex forwardly, thereby maintaining the pack frame and its load closely adjacent the wearer's body.

The use of pivoting connector 16 and/or flexible joiners 70 in applicant's new pack frame allows the load being carried by the wearer to move with the wearer's body, rather than against the weight shifts and directional changes of the body which occur during walking. The present invention, in effect, changes the load carried on the pack frame from a static load to a more easily carried dynamic load.

Referring now to FIGS. 9 and 10, one method of interconnecting adjacent elements such as 62 and 68 by means of a flexible joiner member 70 is shown. As shown, the adjacent ends of tubular elements 62 and 68 are cut with a bevel to define an angle "X". In the preferred embodiment of the present invention, it has been found that an angle "X" equal to approximately 15° produces very satisfactory results. However, angles as small as 10° or significantly larger than 20° may also produce satisfactory results, depending in part upon the selection of materials used to form flexible joiner members 70. In FIG. 9, member 70 is shown in the vertical unflexed position with the rearward portions 72 and 74 of tubular members 62 and 68 being in contact with each other to thereby prevent appreciable rearward tilting movement of member 68 relative to member 62. Referring to FIG. 10, member 68 is shown flexed forwardly with respect to member 62, such that the contact of beveled edges 76 and 78 of members 62 and 68 respectively, acts to limit the forward movement of member 68.

Referring additionally to FIGS. 11 and 12, one typical method of constructing a flexible joiner member 70 is disclosed. In FIG. 11, a flat plate spring member 84, which may be formed of spring steel, plastic, or the like, is shown sandwiched between a pair of generally semicylindrical spacer members 80 and 82. In a preferred embodiment, members 80 and 82 may be formed of resilient nylon, but it will be understood that other flexible, resilient and easily shaped materials may also be substituted therefor. Members 80, 82, and 84 together form a "sandwich" spring which is adapted to flex unidirectionally transverse the width of member 84. Members 80 and 82 act both as supports and spacers for element 84, and together therewith form a cylindrical member sized to fit snugly within the adjacent ends of pack frame side members such as 62 and 68. In one embodiment, members 80 and 82 have been glued to plate spring member 84, and the entire unit in turn glued within the ends of tubular members such as 62 and 68 to avoid displacement of the flexible joiner member during use, and consequent disconnection of members 62 and 68. Alternatively, as shown in FIG. 11, aligned holes may be provided in elements 80, 82 and 84 adapted to receive fastening members such as pins 86. In still another embodiment, pins 86 may be shaped to additionally extend through aligned holes in tubular members 62 and 68.

Figure 13:
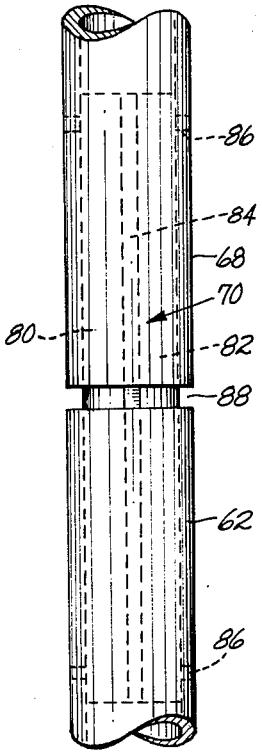
FIG. 13 is an elevation view of another typical embodiment of a flexible joiner member made in accordance with the present invention wherein the adjacent ends of the tubular members are maintained spaced at a distance from each other.
Figure 14:
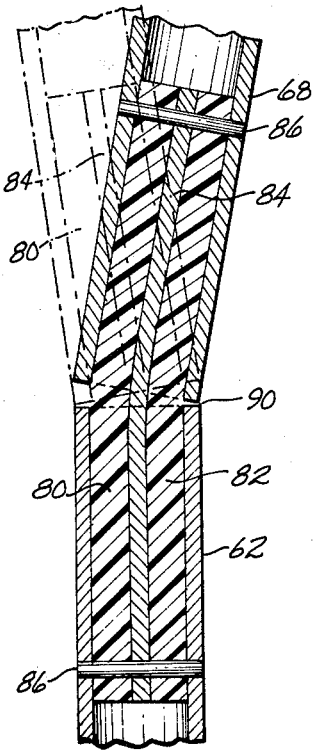
FIG. 14 is a section view of the flexible joiner member of FIG. 13 showing the upper tubular member tilted with respect to the lower tubular member to which it is connected, and showing the upper tubular member tilted in the opposite direction in broken line.

Referring now to FIGS. 13 and 14, an alternate method of interconnecting two adjacent tubular members, such as 62 and 68, is disclosed whereby flexible joiner member 70 of the type heretofore described with respect to FIG. 11, is shown held by pins 86 between two vertically spaced elements 62 and 68. Gap 88 is maintained between elements 62 and 68 so long as joiner member 70 remains in an unflexed condition as shown in FIG. 13. When flexed forwardly, however, gap 88 is closed at the forward edge of elements 62 and 68 as shown in FIG. 14. It will be understood that when sufficiently tilted, the adjacent edges of tubular members 62 and 68 contact each other, such as at 90, and prevent further tilting of one member with respect to the other.

Figure 15:
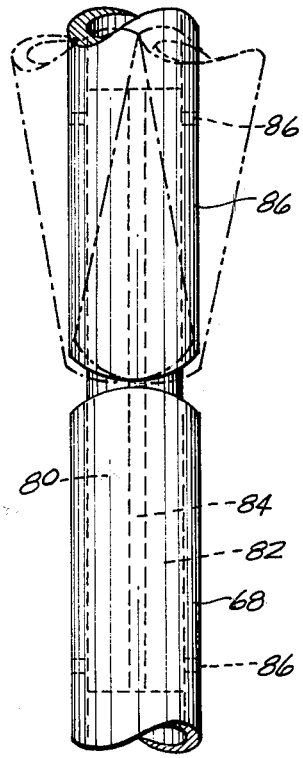
FIG. 15 is still another typical embodiment of a flexible joiner member made in accord with the present invention wherein the ends of the adjacent tubular members contact each other only in the plane transverse to the plane of tilting movement of the upper tube member, the unidirectional tilting movement of the upper tube member with respect to the lower tube member being shown in broken line.

Referring additionally to FIG. 15, still another embodiment of a typical connection constructed according to the instant invention is disclosed wherein the adjacent ends of tubular members 62 and 68 are curved such that they contact each other only at points laterally adjacent to plate spring 84 when the spring is in its unflexed position. When flexing occurs, the bottom end of element 68 rocks upon the top end of element 62, the degree of rocking being limited principally by the increased resistance to flex encountered when plate spring 84 and spacers 80 and 82 are deformed substantially beyond the 15° to 20° flex range discussed before.

While the attached drawings disclose a single flex joint positioned in each of the upwardly extending side members of the pack frame, it will be understood that two or more flex joints could also be employed in each side member to increase the flexibility and twistability of the pack frame. It is considered that spacing the flex joints two to four inches vertically apart on the side members will produce the desired improved performance.

In FIGS. 16 and 17, a pack bag 92 is disclosed mounted upon a laterally pivoting, forwardly flexing pack frame such as frame 10 discussed earlier with respect to FIGS. 1 and 2. Pack bag 92 includes a lower hip-surrounding portion 94 interconnected to the lower section 14 of the pack frame. Pack bag 92 also includes an upper portion 96 interconnected to upper section 12 of the pack frame. A pair of pleated bellows 98 are provided between and flexibly interconnect the lower and upper sections 94 and 96 of the pack bag. The pair of pleated bellows 98 are joined at their apex on the front surface of the pack bag adjacent pivoting connector 16, and are similarly joined on the back surface of the pack bag rearward of pivoting connector 16.

The provision of pleated bellows sections in the wall surface of the pack bag adjacent pivoting connector 16 allows the upper portion 96 of the pack bag, even when substantially filled, to follow the lateral pivoting of the upper portion 12 and lower portion 14 of the pack frame, which occurs when the wearer is walking. Pack bag 92 and pack frame 10 thus cooperate with each other to provide a load carrying system which allows a load carried on the wearer's back to move with the hiker's body, rather than in opposition thereto.

Referring also to FIGS. 18 and 19, an alternate form of a laterally pivoting pack bag is disclosed, including a single pleated bellows section 100 interconnecting lower pack bag section 94 with upper pack bag section 96. In all of FIGS. 16–19, the upper section 96 of the pack bag is itself shown to include a collapsible, foldable upper section 102 sewn or otherwise fastened to the top portion thereof, with a final top cap or cover 104 adapted to be slipped thereover, and held thereon, by means of conventional fasteners such as straps and buckles 106. Foldable or collapsible upper section 102 may be pleated in the manner shown in FIGS. 18 and 19 at 100, or it may simply be formed of a material which may be easily compressed, in the manner shown in FIG. 19, when it is desired to decrease the capacity of the pack bag such as on a short hike when a limited amount of equipment will be needed. For longer hikes, however, section 102 may be easily extended as the pack bag is filled, with buckles and straps 106 being adjusted accordingly to produce a pack bag of desired volume. Access to the pack bag is provided not only through zippered pockets such as 108, but also by disengaging straps and buckles 106 on the rear of the pack bag such that top cap 104 may be opened upwardly.

The invention may be embodied in other specific forms without departing from the spirit or central characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. An improved load carrying pack frame for hiking comprising:

a hip portion forming the lower portion of the pack frame adapted to be connected to a wearer's hips;

a shoulder portion forming the upper portion of the pack frame adapted to be connected to a wearer's shoulders;

pivot means securely interconnecting with said hip portion and said shoulder portion at a point above said wearer's hips and below said wearer's shoulders to simultaneously interconnect said hip portion and said shoulder portion and permit said hip portion and said shoulder portion to pivot laterally with respect to each other about said pivot means without generating reactive countermovements responsive to the relative movement of said wearer's hips and shoulders such that the load carried by said hip portion dynamically follows the movement of the wearer's hips and such that the load carried by said shoulder portion dynamically follows the movement of the wearer's shoulders;

said pivot means being adapted to prevent relative rotational movement between said shoulder portion and said hip portion of said pack frame about an axis longitudinal of said pack frame.

2. The pack frame of claim 1 wherein said hip portion includes a generally tubular frame adapted to be connected to a pack bag, said hip portion having a laterally extending top member detachably connected to said pivot means, and a pair of laterally spaced, downwardly extending side members disposed forwardly of said top member and laterally adjacent the wearer's hips, said side members being interconnected near their lower ends by at least one laterally and forwardly extending tubular cross member.

3. The pack frame of claim 1 wherein said shoulder portion comprises a closed, substantially tubular frame disposed above said hip portion and adapted to be connected to a pack bag, said tubular frame having a laterally extending bottom member connected to said pivot means, and a pair of laterally spaced, upwardly extending tubular side members interconnected by at least one vertically adjustable laterally extending tubular cross member; and shoulder strap means adapted to extend over a wearer's shoulders to hold said tubular frame closely adjacent a wearer's shoulders.

4. The pack frame of claim 3, wherein said shoulder portion tubular side members each include an upper portion and a lower portion, said upper and lower portions being interconnected for relative movement therebetween by a resiliently flexible joiner member such that each of said upper portions is tiltable forwardly from its substantially vertical untilted position through a limited predetermined angle with respect to the lower portion to which it is connected but is constrained against lateral, twisting and longitudinal movement during walking motion of a wearer.

5. The pack frame of claim 1 wherein said pivot means comprises a first gripping means detachably and rigidly interconnectable with said shoulder portion, a second gripping means detachably and rigidly interconnectable with said hip portion, and pin means centered in respect to a wearer's body for detachably and adjustably interconnecting said first and second gripping means such that a selective torque preload can be applied to said pivot means to enable said two gripping means to pivot with respect to each other in response to the walking movement of the wearer's body while carrying the pack frame while simultaneously preventing relative movement between said first gripping means and said shoulder portion and between said second gripping means and said hip portion.

6. The pack frame of claim 5 wherein said means for adjustably interconnecting said first and second gripping means comprises a bolt having a head end and a threaded end extending through aligned openings in said first and second gripping means; plastic washer means mounted on said bolt between said first and second gripping means; and an internally threaded nut cooperatingly mounted on said threaded end of said bolt and adapted to cooperate with the head end of said bolt to selectively squeeze said first and second gripping means against said plastic washer.

7. The pack frame of claim 1 wherein said pivot means interconnecting said hip portion and said shoulder portion comprises:

a first gripping means adapted to securely grip said hip portion of said pack frame;

a second gripping means adapted to securely grip said shoulder portion of said pack frame;

said first and second gripping means each including shank means having openings therein adapted to be aligned with each other;

plastic washer means having a central opening positioned between said shank means of said first and second gripping means such that said central opening is aligned with said shank openings; and, connector means extending through said openings in said shank means and said washer means and pressing said shank means against said washer means to control the relative pivotal movement between said hip portion and shoulder portion of said pack frame such that a prescribed torque load is required to be applied to said pivot means to enable said hip portion and said shoulder portion to pivot relative to each other.

8. The pack frame of claim 1 wherein said shoulder portion of said pack frame includes an upper portion and a lower portion, said upper and lower portions being interconnected by joiner means adapted to flex in a unidirection whereby said upper portion is restrained to tilt generally forwardly with respect to said lower portion.

9. The pack frame of claim 1 including a pack bag mounted on said pack frame, said pack bag including an upper shoulder portion mounted on said frame shoulder portion and a lower hip portion mounted on said frame hip portion, said upper and lower pack bag portions being interconnected by an oppositely flaring double pleated fabric section adjacent said pack frame pivot means whereby said upper portion may pivot laterally with respect to said lower portion when said bag is filled to allow said bag to follow the pivoting movement of said pack frame.

10. The pack frame of claim 1 wherein said pivot means includes clamp means which when loosened allows relative angular adjustment between said shoulder portion and said hip portion in a fore and aft direction and which when clamped secures said shoulder and hip portions in fixed angular relationship in such fore and aft direction.

11. An improved backpack load carrying system for hikers comprising:

a frame having a hip portion and a shoulder portion;

pivot means securely interconnecting said hip portion and said shoulder portion at a point centrally adjacent a wearer's back and at an elevation between a wearer's hips and shoulders and adapted to allow said hip portion and said shoulder portion to pivot laterally thereabout without generating reactive counter-movements responsive to the relative movement of said wearer's hips and shoulders; and a pack bag mounted on said pack frame including a hip portion connected to said hip portion of said frame and a shoulder portion connected to the shoulder portion of said frame, said hip and shoulder portions of said bag being interconnected by a pleated fabric section adjacent said pivot means of said pack frame to enable said bag hip portion to follow the movement of the hips of the wearer and to enable the bag shoulder portion to follow the movement of the shoulders of the wearer.

12. The backpack load carrying system of claim 11 wherein said shoulder portion of said pack frame includes an upper portion and a lower portion, said upper and lower portions being interconnected by resiliently flexible joiner means such that said upper portion is constrained against rearward movement from its substantially vertical untilted position and adapted to tilt forwardly through a limited angle with respect to said lower portion.

13. An articulated pack frame adapted to be worn on the human back comprising:

a hip portion having a tubular top member, a pair of downwardly extending tubular side members connected to said top member, and a tubular bottom member interconnecting said side members below said top member, said side members being disposed forwardly of said bottom member to a position generally laterally adjacent a wearer's hips;

a shoulder portion disposed above said hip portion having a tubular bottom member and a pair of upwardly extending tubular side members connected to said bottom member, said tubular side members being interconnected by at least one tubular cross member above said tubular bottom member;

pivoting connector means interconnecting said hip portion and said shoulder portion adjacent the middle of a wearer's back at a point above the wearer's hips and below the wearer's shoulders, said connector means securely interconnecting with said hip portion and with said shoulder portion to allow said hip portion and said shoulder portion of said pack frame to pivot laterally about said connector means to follow the movement of the wearer's hips and shoulders while said wearer walks without generating reactive countermovements tending to move said hip and shoulder portions of said frame contrary to the movement of said wearer's hips and shoulders;

said connector means being adjustable to require a constant prescribed torque load to be applied to said connector means to enable said hip portion and said shoulder portion of said backpack frame to pivot laterally with respect to each other about said connector means.

14. The articulated pack frame of claim 13 wherein said upwardly extending tubular side members of said shoulder portion each include an upper tubular portion and a lower tubular portion interconnected by flexible joiner means whereby said upper portions are restrained to tilt generally forwardly with respect to said lower portions.

15. The articulated pack frame of claim 13 wherein said pivoting connector means interconnecting said hip portion and said shoulder portion comprises:

a first gripping means adapted to detachably grip said tubular top member of said hip portion, said first gripping means including a first outer portion and a first inner portion separate from said first outer portion, each of said first outer and inner portions including a curved section partially encircling said tubular top member and a shank section of a thickness considerably greater than said curved section, said shank section having openings therein adapted to be aligned with each other;

a second gripping means adapted to detachably grip said tubular bottom member of said shoulder portion, said second gripping means including a second outer portion and a second inner portion separate from said second outer portion, each of said second outer and inner portions including a curved section partially encircling said tubular bottom member and a shank section of a thickness considerably greater than the curved section, said shank sections having openings therein adapted to be aligned with each other;

plastic washer means having a central opening and positioned between said shank means of said first and second gripping means such that said central opening is aligned with said shank openings; and, fastener means extending through openings in and pressing together said shank sections of said first gripping means, said washer means and said shank sections of said second gripping means to control the relative pivotal movement between said hip portion and said shoulder portion of said pack frames such that an initial torque load is required to be applied to said pivot means to enable said hip portion and said shoulder portion to pivot relative to each other.

16. The articulated backpack of claim 15 wherein said shank sections of said first gripping means is of a width substantially larger than the diameter of said tubular top member of said hip portion, and wherein said shank sections of said second gripping means is of a width considerably larger than the diameter of said tubular bottom member of said shoulder portion.

17. A pack frame for hikers comprising:

laterally spaced tubular side member means of generally fixed length extending from the waist to above the shoulders of a wearer and having vertically spaced vertically adjustable tubular cross member means interconnecting said side member means;

said tubular side member means each including an upper portion and a lower portion interconnected longitudinally end to end at an elevation between the hips and shoulders of a wearer;

flexible joiner means for interconnecting said upper and lower portions of each of said tubular side members whereby said upper portions of said side members may tilt substantially in a plane forwardly with respect to said lower portions of said side members responsive to forces exerted thereon while said pack frame is carried during hiking; and, said upper portions being adapted to return to their aligned longitudinal relationship with said lower portion with little or no residual oscillation generated between said portions.

18. The pack frame of claim 17 wherein said flexible joiner means for interconnecting said upper and lower portions of each of said tubular side members comprises a cylindrical sandwich member having a maximum diameter substantially equal to the internal diameter of said tubular side members and adapted to be inserted in the adjacent ends of the upper and lower portions of each of said side members, said cylindrical sandwich member comprising a centrally located, longitudinally extending plate spring positioned between a pair of flexible, resilient, substantially hemicylindrical spacer members.

19. The pack frame of claim 18 wherein said plate spring is substantially rectangular in cross section and formed of spring steel.

20. The pack frame of claim 18 including pin means extending through aligned openings in said tubular side members, said spacer members and said spring members to hold said flexible joiner means between said upper and lower portions of said tubular side members.

21. The pack frame of claim 17 wherein the adjacent end portions of said upper and lower portions of said tubular side members are beveled with respect to each other whereby when said upper portion tilts forwardly with respect to said corresponding lower portion, substantially the entire adjacent end surfaces of said upper and lower portions bear against each other to limit the movement of said upper portion in respect to said lower portion.

22. The pack frame of claim 21 wherein the angle defined by the beveled ends of the upper and lower portions of said tubular side members is between 10% and 20%.

23. The pack frame of claim 17 wherein:

when said upper and lower portions of said tubular side members are disposed in their normally aligned relationship, the adjacent ends of said upper and lower portions contact each other only at points on the lateral sides of said tubes; and when said upper portion is tilted forwardly with respect to its corresponding lower portion, substantially the entire forward portions of the adjacent end surfaces bear against each other to limit the tilting movement of said upper portion in respect to said lower portion.

24. The pack frame of claim 17 wherein said flexible joiner means maintain the adjacent ends of said upper and lower portions of said tubular side members spaced apart from each other when said upper and lower portions are aligned longitudinally, but allow end to end contact when said upper portion tilts forwardly with respect to said lower portion, the end-to-end contact of the ends of said upper and lower portions of said tubular side members limiting the forward tilting of said upper portion with respect to said lower portion.

25. The pack frame of claim 17 wherein:

each of said tubular side members is formed by a plurality of pieces;

flexible joinder means are disposed between adjacent pieces of each of said side members to interconnect said adjacent pieces in substantially end to end relationship; and each of said flexible joinder means comprises a resilient, flexible, cylindrical member having an external diameter substantially equal to the internal diameter of said tubular members and adapted to be disposed within and extend between adjacent pieces of each of said tubular members.

26. A pack frame for hikers comprising:

a pair of laterally spaced tubular side member means extending from the wearer's hips to the wearer's shoulders, and at least three vertically spaced, adjustable, tubular, transverse member means extending between said side member means;

hip belt means connected to the lower portion of said frame and adapted to hold said frame adjacent the wearer's hips;

a pair of shoulder strap means each having one end connected to said frame adjacent said wearer's shoulders and the opposite end connected to said frame adjacent said wearer's hips, and adapted to overlie said wearer's shoulders;

each of said tubular side member means being formed from a plurality of longitudinally aligned tubular elements; and, joiner means interconnecting adjacent tubular elements of each of said tubular side member means at a point between the hips and shoulders of said wearer such that the upper portions of said side members are restricted to tilt generally forwardly through a limited predetermined angle with respect to the lower portions of said side members.

27. The pack frame of claim 26 wherein substantially the entire adjacent ends of said adjacent tubular elements of each of said tubular side members are beveled with respect to each other; and, wherein said flexible joiner means comprises a resilient plug extending into and between said adjacent beveled ends of said tubular side members.

28. The pack frame of claim 26 wherein said flexible joiner means comprises flexible plug means extending into and between the adjacent ends of said adjacent tubular elements of each of said tubular side member means; said flexible joiner means being adapted to maintain said adjacent ends out of contact with each other when said tubular elements being in aligned relationship to thereby facilitate tilting of said upper portion with respect to said lower portion.

29. The pack frame of claim 26 wherein the adjacent end portions of adjacent tubular elements of each of said tubular side members are curved such that when said upper portions of each of said tubular side members are tilted forwardly relative to said corresponding lower portion said adjacent end portions make rolling contact with each other.

30. The pack frame of claim 26 wherein said flexible joiner means comprises cylindrical plug means insertable into and extending between the adjacent ends of said tubular elements; said plug means being of substantially uniform cross-sectional size and comprising a longitudinally extending core of flexible spring material overlaid by a resilient material readily formable to fit into said adjacent tubular elements.

31. An enclosed pack bag for use on a tubular pack frame characterized by upper and lower frame portions which are pivotally moveable relative to one another responsive to movement of a wearer of the pack frame during use of the frame and pack bag, said pack bag comprising:

a generally vertical tubular body portion, a top end portion and a bottom end portion;

said tubular body portion including an upper pack portion generally located at the said upper frame portion, a lower pack portion generally located at the said lower frame portion, and a pleated intermediate portion interconnecting said upper and lower pack portions which is vertically expansible and contractible to accommodate such relative movement of said frame portions.

32. The pack bag of claim 31 wherein said pleated intermediate portion comprises a pair of laterally extending bellows joined on the lateral mid-point of said bag.

* * * * *